US008951370B2

(12) United States Patent
Sekiya et al.

(10) Patent No.: US 8,951,370 B2
(45) **Date of Patent: *Feb. 10, 2015**

(54) ALUMINUM ALLOY WIRE MATERIAL

(75) Inventors: Shigeki Sekiya, Tokyo (JP); Kuniteru Mihara, Tokyo (JP); Kyota Susai, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/184,901

(22) Filed: Jul. 18, 2011

(65) Prior Publication Data

US 2011/0272175 A1 Nov. 10, 2011

Related U.S. Application Data

(63) Continuation of application No. PCT/CT2010/050577, filed on Jan. 19, 2010.

(30) Foreign Application Priority Data

Jan. 19, 2009 (JP) ..... 2009-009370

(51) Int. Cl.
*C22C 21/00* (2006.01)
*H01B 1/02* (2006.01)

(52) U.S. Cl.
USPC ..... 148/439; 420/535; 420/551; 174/72 A; 174/113 R

(58) Field of Classification Search
USPC ..... 148/439; 420/535, 551, 534, 537, 538; 174/72 A, 113 R
See application file for complete search history.

(56) References Cited

U.S. PATENT DOCUMENTS 3,663,216 A * 5/1972 Hunsicker ..... 420/533
2003/0059336 A1 3/2003 Aida et al.
2003/0111256 A1 6/2003 Fujiwara
2008/0196923 A1* 8/2008 Susai et al. ..... 174/110 R

FOREIGN PATENT DOCUMENTS

| | | | |
|---|---|---|---|
| EP | 1 291 992 | A1 | 3/2003 |
| EP | 1295956 | A2 | 3/2003 |
| FR | 2 857 377 | A1 | 1/2005 |
| GB | 1 498 357 | A | 1/1978 |
| JP | 48-023609 | U | 3/1973 |
| JP | 49-078616 | A | 7/1974 |
| JP | 49-043162 | B | 11/1974 |
| JP | 10-226839 | A | 8/1998 |
| JP | 2000-357420 | A | 12/2000 |
| JP | 2003-105468 | A | 4/2003 |
| JP | 2004-134212 | A | 4/2004 |
| JP | 3530181 | B1 | 5/2004 |
| JP | 2004-311102 | A | 11/2004 |
| JP | 2005-174554 | A | 6/2005 |
| JP | 2005-336549 | A | 12/2005 |
| JP | 2006-12468 | A | 1/2006 |
| JP | 2006-019163 | A | 1/2006 |
| JP | 2006-019164 | A | 1/2006 |
| JP | 2006-019165 | A | 1/2006 |
| JP | 2006-079885 | A | 3/2006 |
| JP | 2006-079886 | A | 3/2006 |
| JP | 2006-253109 | A | 9/2006 |
| WO | WO 2006/085638 | A1 | 8/2006 |

* cited by examiner

*Primary Examiner* — Roy King
*Assistant Examiner* — Janelle Morillo
(74) *Attorney, Agent, or Firm* — Birch, Stewart, Kolasch & Birch, LLP.

(57) ABSTRACT

An aluminum alloy wire material, which has an alloy composition containing: 0.1 to 0.4 mass % of Fe, 0.1 to 0.3 mass % of Cu, 0.02 to 0.2 mass % of Mg, and 0.02 to 0.2 mass % of Si, and further containing 0.001 to 0.01 mass % of Ti and V in total, with the balance being Al and unavoidable impurities, in which a grain size is 5 to 25 μm in a vertical cross-section in a wire-drawing direction of the wire material, in which, according to JIS Z 2241, a tensile strength (TS) is 80 MPa or more, an elongation (El) is 15% or more, and a 0.2% yield strength (YS; MPa) satisfies, together with the TS, a relationship represented by formula: $1.5 \leq (TS/YS) \leq 3$, and in which an electrical conductivity is 55% IACS or more.

10 Claims, No Drawings

ALUMINUM ALLOY WIRE MATERIAL

CROSS REFERENCE TO RELATED APPLICATIONS

This application is a Continuation of PCT International Application No. PCT/JP2010/050577 filed on Jan. 19, 2010, which claims priority of Application No. 2009-009370 filed in Japan on Jan. 19, 2009, all of which are hereby expressly incorporated by reference into the present application.

TECHNICAL FIELD

The present invention relates to an aluminum alloy wire material that is used as a conductor of an electrical wiring.

BACKGROUND ART

Hitherto, a member in which a terminal (connector) made of copper or a copper alloy (for example, brass) is attached to electrical wires composed of conductors of copper or a copper alloy, which is called a wire harness, has been used as an electrical wiring for movable bodies, such as automobiles, trains, and aircrafts. In weight reduction of movable bodies in recent years, studies have been progressing on use of aluminum or an aluminum alloy that is lighter than copper or a copper alloy, as a conductor for an electrical wiring.

The specific gravity of aluminum is about one-third of that of copper, and the electrical conductivity of aluminum is about two-thirds of that of copper (when pure copper is considered as a criterion of 100% IACS, pure aluminum has about 66% IACS). Therefore, in order to pass a current through a conductor wire material of pure aluminum, in which the intensity of the current is identical to that through a conductor wire material of pure copper, it is necessary to adjust the cross-sectional area of the conductor wire material of pure aluminum to about 1.5 times larger than that of the conductor wire material of pure copper, but aluminum conductor is still more advantageous than copper conductor in that the former has an about half weight of the latter.

Herein, the term "% IACS" mentioned above represents an electrical conductivity when the resistivity $1.7241\times10^{-8}$ Ωm of International Annealed Copper Standard is defined as 100% IACS.

In order to use the aluminum as a conductor of an electrical wiring of a movable body, the aluminum is produced by cumulation of several techniques, one of which is a technique for producing a stranded wire. Stranded wires are generally classified into two kinds, one of which is obtained by stranding a drawn material, and the other of which is obtained by stranding an annealed material. In either case, even the same material is used, the shape of the stranded wire after stranding differs, depending on the difference in tensile strength (TS), 0.2% yield strength (YS), and elongation (El).

The shape of a stranded wire is determined based on a twist pitch (or a lay length), when a central wire wound with solid wires is stranded or twisted. When the twist pitch is narrow, the state of the strand becomes dense. On the other hand, when the twist pitch is broad, gaps are formed in twist intervals. Further, a problem of stranding is that, when irregularity of stranding, protrusion of stranding, or the like occurs, a failure occurs in the subsequent step, such as a coating step. Furthermore, when such irregularity of stranding, protrusion of stranding, or the like exist, wart-like appearance is confirmed even from the top of a coating. In such a state, a defect called kink is apt to occur, which leads to clogging of an automatic feeding apparatus and the like in a step of assembling a harness, and the like.

Furthermore, a solid wire in an electrical wire that is used in harnesses has a small diameter of 0.3 mmϕ or less, and it is not a thick electrical wire as used in overhead electric power transmission lines.

Therefore, it is considered that use of a coated thin electrical wire (solid wire) is one of the features of a conductor that is used in movable bodies.

With respect to such a use, pure aluminum (1000-series) is used in electric power transmission lines in many cases, but it is low in tensile strength and has an insufficient mechanical strength for use in an electrical wire for harnesses. Accordingly, alloying by adding various additive elements has been studied. However, it is also a well-known fact that alloying causes decrease in electrical conductivity. Therefore, 2000-series and 6000-series that are excellent in mechanical strength cannot be used, and other alloy-systems are also not so good.

On the other hand, as aluminum conductors used for electronic wirings of movable bodies, Patent Literatures 1 to 13 mainly describe about wire harnesses for automobiles. It is necessary that an aluminum conductor for harnesses is used in the form of a stranded wire, and thus, mechanical properties that enable readily stranding are desired. Furthermore, the wire diameter thereof is thin as 0.3 mmϕ or less, and further the surface thereof is coated. Therefore, such matters are not envisaged in pure aluminum-based materials that are used for electric power transmission lines and electrical power cables, and in the materials described in Patent Literatures 1 to 13. Thus, those materials are not considered to have properties and costs that are required for use in movable bodies.

Specifically, the alloys to which Zr is added, as described in Patent Literatures 1, 3, 4, 8, 11 to 13, and the like, are ones improved in creep resistance, but they have a problem of low electrical conductivity. Furthermore, there is another problem that a heat treatment for a long time period is required for forming an $Al_3Zr$ intermetallic compound, which makes control of the process difficult.

CITATION LIST

Patent Literature

Patent Literature 1: JP-A-2004-311102 ("JP-A" means unexamined published Japanese patent application)
Patent Literature 2: JP-A-2006-12468
Patent Literature 3: Japanese Patent No. 3530181
Patent Literature 4: JP-A-2005-336549
Patent Literature 5: JP-A-2004-134212
Patent Literature 6: JP-A-2005-174554
Patent Literature 7: JP-A-2006-19164
Patent Literature 8: JP-A-2006-79885
Patent Literature 9: JP-A-2006-19165
Patent Literature 10: JP-A-2006-19163
Patent Literature 11: JP-A-2006-253109
Patent Literature 12: JP-A-2006-79886
Patent Literature 13: JP-A-2000-357420

SUMMARY OF INVENTION

Technical Problem

The present invention is contemplated for providing a wire material to be mounted on a movable body, which wire material is excellent in both of mechanical properties and electrical conductivity, specifically an aluminum alloy wire material which is preferable for a stranded wire used in usage of a wire harness, and the like.

Solution to Problem

As mentioned above, a stranded wire rather than a solid wire is generally used in a wire harness to be mounted on movable bodies. This is because a stranded wire bends more flexibly, is excellent in bending property, and has a high reliability since even one of elemental wires (solid wires) that constitute the stranded wire is broken, there is little problem on use as long as other elemental wires remain unbroken.

Thus, various mechanical properties are required for a solid wire to be worked into a stranded wire. In general, the properties are shown by the relationship between mechanical strength and elongation in many cases. However, when the working step in working into a stranded wire is taken into consideration, the properties cannot be defined simply by such two parameters. Namely, a work-hardening index (n value) is an important parameter for the deformation behavior in the working step. The work-hardening index can be represented by a ratio (TS/YS) of tensile strength (TS) and 0.2% yield strength (YS) of a material, and a preferable stranded wire can be produced by controlling the value of TS/YS.

In view of such the circumstances, the inventors of the present invention have studied a method for evaluating the properties of an elemental wire for providing a desirable stranded wire of an electrical conductor for movable bodies. In addition to the above, in order to satisfy the mechanical properties of the elemental wire required in the test and evaluation method, we have further studied to specify the alloying elements to be added to aluminum, the grain size on a vertical cross-section in the wire-drawing direction of a wire, the particle size (the diameter of a compound particle) of intermetallic compound particles to be dispersed, as well as necessary mechanical strength and electrical conductivity, and to define the ratio (TS/YS) of tensile strength and 0.2% yield strength. The present invention is attained based on those studies.

That is, the present invention is to provide:

(1) An aluminum alloy wire material, which has an alloy composition comprising: 0.1 to 0.4 mass % of Fe, 0.1 to 0.3 mass % of Cu, 0.02 to 0.2 mass % of Mg, and 0.02 to 0.2 mass % of Si, and further comprising 0.001 to 0.01 mass % of Ti and V in total, with the balance being Al and unavoidable impurities, wherein a grain size is 5 to 25 μm in a vertical cross-section in a wire-drawing direction of the wire material, wherein, according to JIS Z 2241, a tensile strength (TS) is 80 MPa or more, an elongation (El) is 15% or more, and a 0.2% yield strength (YS; MPa) satisfies, together with the TS, a relationship represented by formula: $1.5 \leq (TS/YS) \leq 3$, and wherein an electrical conductivity is 55% IACS or more;

(2) An aluminum alloy wire material, which has an alloy composition comprising: 0.1 to 0.4 mass % of Fe, 0.1 to 0.3 mass % of Cu, 0.02 to 0.2 mass % of Mg, and 0.02 to 0.2 mass % of Si, and further comprising 0.001 to 0.01 mass % of Ti and V in total, with the balance being Al and unavoidable impurities, wherein a grain size is 5 to 25 μm in a vertical cross-section in a wire-drawing direction of the wire material, wherein, according to JIS Z 2241, a tensile strength (TS) is 80 MPa or more, an elongation (El) is 15% or more, and a 0.2% yield strength (YS; MPa) satisfies, together with the TS, a relationship represented by formula: $1.2 \leq (TS/YS) \leq 2.2$, and wherein an electrical conductivity is 55% IACS or more;

(3) An aluminum alloy wire material, which has an alloy composition comprising: 0.1 to 0.4 mass % of Fe, 0.1 to 0.3 mass % of Cu, 0.02 to 0.2 mass % of Mg, and 0.02 to 0.2 mass % of Si, and further comprising 0.001 to 0.01 mass % of Ti and V in total, with the balance being Al and unavoidable impurities, wherein a grain size is 5 to 25 μm in a vertical cross-section in a wire-drawing direction of the wire material, wherein, according to JIS Z 2241, a tensile strength (TS) is 80 MPa or more, an elongation (El) is 15% or more, and a 0.2% yield strength (YS; MPa) satisfies, together with the TS, a relationship represented by formula: $1 \leq (TS/YS) \leq 2$, and wherein an electrical conductivity is 55% IACS or more;

(4) An aluminum alloy wire material, which has an alloy composition comprising: 0.3 to 0.8 mass % of Fe, and 0.02 to 0.5 mass % of at least one element selected from the group consisting of Cu, Mg, and Si in total, and further comprising 0.001 to 0.01 mass % of Ti and V in total, with the balance being Al and unavoidable impurities, wherein a grain size is 5 to 30 μm in a vertical cross-section in a wire-drawing direction of the wire material, wherein, according to JIS Z 2241, a tensile strength (TS) is 80 MPa or more, an elongation (El) is 15% or more, and a 0.2% yield strength (YS; MPa) satisfies, together with the TS, a relationship represented by formula: $1.5 \leq (TS/YS) \leq 3$, and wherein an electrical conductivity is 55% IACS or more;

(5) An aluminum alloy wire material, which has an alloy composition comprising: 0.3 to 0.8 mass % of Fe, and 0.02 to 0.5 mass % of at least one element selected from the group consisting of Cu, Mg, and Si in total, and further comprising 0.001 to 0.01 mass % of Ti and V in total, with the balance being Al and unavoidable impurities, wherein a grain size is 5 to 30 μm in a vertical cross-section in a wire-drawing direction of the wire material, wherein, according to JIS Z 2241, a tensile strength (TS) is 80 MPa or more, an elongation (El) is 15% or more, and a 0.2% yield strength (YS; MPa) satisfies, together with the TS, a relationship represented by formula: $1.2 \leq (TS/YS) \leq 2.2$, and wherein an electrical conductivity is 55% IACS or more;

(6) An aluminum alloy wire material, which has an alloy composition comprising: 0.3 to 0.8 mass % of Fe, and 0.02 to 0.5 mass % of at least one element selected from the group consisting of Cu, Mg, and Si in total, and further comprising 0.001 to 0.01 mass % of Ti and V in total, with the balance being Al and unavoidable impurities, wherein a grain size is 5 to 30 μm in a vertical cross-section in a wire-drawing direction of the wire material, wherein, according to JIS Z 2241, a tensile strength (TS) is 80 MPa or more, an elongation (El) is 15% or more, and a 0.2% yield strength (YS; MPa) satisfies, together with the TS, a relationship represented by formula: $1 \leq (TS/YS) \leq 2$, and wherein an electrical conductivity is 55% IACS or more; and (7) The aluminum alloy wire material according to any one of (1) to (6), which is mounted on a movable body as a wiring, and used in the form of a stranded wire as an electric conductor for a battery cable, a wire harness, or a motor.

Advantageous Effects of Invention

The aluminum alloy wire material of the present invention has mechanical properties and an electrical conductivity, each of which are favorable for an electrically-conductive stranded wire to be mounted on a movable body, and it is useful as a conductor for battery cables, wire harnesses or motors.

MODE FOR CARRYING OUT THE INVENTION

The alloy composition of the aluminum alloy wire material of a preferable first embodiment of the present invention comprises 0.1 to 0.4 mass % of Fe, 0.1 to 0.3 mass % of Cu, 0.02 to 0.2 mass % of Mg, and 0.02 to 0.2 mass % of Si, and further comprises 0.001 to 0.01 mass % of Ti and V in total, with the balance being Al and unavoidable impurities.

In this embodiment, the reason why the content of Fe is set to 0.1 to 0.4 mass % is to utilize various effects by mainly Al—Fe-based intermetallic compounds, specifically, to obtain effects of enhancing mechanical properties and improving electrical conductivity, each of which are preferable for an electrically-conductive stranded wire. Fe is made into a solid solution in aluminum in an amount of only about 0.05 mass % at a temperature (655° C.) around the melting point, and is made into a solid solution lesser at room temperature. The remainder of Fe is crystallized or precipitated as intermetallic compounds, such as Al—Fe, Al—Fe—Si, Al—Fe—Si—Mg, and Al—Fe—Cu—Si. The crystallized or precipitated product acts as a refiner for grains to make the grain size fine, and enhances the mechanical strength. When the content of Fe is too small, this effect becomes insufficient. When the content is too large, the effect is saturated, which is not desirable from industrial viewpoints. The content of Fe is preferably 0.15 to 0.3 mass %, more preferably 0.18 to 0.25 mass %.

In this embodiment, the reason why the content of Cu is set to 0.1 to 0.3 mass % is to make Cu into a solid solution in an aluminum matrix, to strengthen the resultant alloy. In such a case, when the content of Cu is too small, the effect thereof cannot be sufficiently exerted, and when the content is too large, decrease in electrical conductivity is caused. Furthermore, when the content of Cu is too large, Cu forms intermetallic compounds with other elements, to cause a defect, such as occurrence of slag upon melting, and the like. The content of Cu is preferably 0.15 to 0.25 mass %, more preferably 0.18 to 0.22 mass %.

In this embodiment, the reason why the content of Mg is set to 0.02 to 0.2 mass % is to make Mg into a solid solution in an aluminum matrix, to strengthen the resultant alloy. Further, another reason is to make a part of Mg form a precipitate with Si, to enhance mechanical strength. When the content of Mg is too small, the above-mentioned effects are insufficient, and when the content is too large, electrical conductivity is decreased and the effects are also saturated. Furthermore, when the content of Mg is too large, Mg forms intermetallic compound with other elements, to cause a defect, such as occurrence of slag upon melting, and the like. The content of Mg is preferably 0.05 to 0.15 mass %, more preferably 0.08 to 0.12 mass %.

In this embodiment, the reason why the content of Si is set to 0.02 to 0.2 mass % is that Si shows an action to form a compound with Mg to enhance the mechanical strength, as mentioned above. When the content of Si is too small, the above-mentioned effect becomes insufficient, and when the content is too large, the electrical conductivity is decreased and the effect is also saturated. Furthermore, when the content of Si is too large, Si forms intermetallic compounds with other elements, to cause a defect, such as occurrence of slag upon melting, and the like. The content of Si is preferably 0.05 to 0.15 mass %, more preferably 0.08 to 0.12 mass %.

In this embodiment, Ti and V each act as a refiner for microstructure of an ingot in melt-casting. If the microstructure of the ingot is coarse, cracks occur in the next working step, which is not desirable from industrial viewpoints. Thus, Ti and V are added so as to refine the microstructure of the ingot. When the content of Ti and V in total is too small, the effect of refining is insufficient, and when the total content is too large, electrical conductivity is conspicuously decreased and the effects are also saturated. The content of Ti and V in total is preferably 0.05 to 0.08 mass %, more preferably 0.06 to 0.08 mass %. Furthermore, when Ti and V are used together, the ratio Ti:V (by mass ratio) is preferably 10:1 to 10:3.

The alloy composition of the aluminum alloy wire material of a preferable second embodiment of the present invention comprises 0.3 to 0.8 mass % of Fe, and 0.02 to 0.5 mass % of at least one element selected from Cu, Mg, and Si in total, and further comprises 0.001 to 0.01 mass % of Ti and V in total, with the balance being Al and unavoidable impurities. Effects of enhancing mechanical properties and improving electrical conductivity that are preferable for an electrically-conductive stranded wire can also be obtained, by the aluminum alloy wire material of the second embodiment, as in the first embodiment.

In the second embodiment, the reason why the content of Fe is set to 0.3 to 0.8 mass % is that, when the content of Fe is too small, the effects of enhancing mechanical properties and improving electrical conductivity, which are preferable for an electrically-conductive stranded wire, become insufficient, depending on the contents of other elements (specifically Cu, Mg, Si); whereas, when the content is too large, the precipitated intermetallics are formed excessively, which causes breakage of the wire upon a wire-drawing step. The content of Fe is preferably 0.4 to 0.8 mass %, more preferably 0.5 to 0.7 mass %.

Further, in the second embodiment, the reason why the content of Cu, Mg, and Si in total is set to 0.02 to 0.5 mass % is that, when the total content is too small, the effects of enhancing mechanical properties and improving electrical conductivity, which are preferable for an electrically-conductive stranded wire, are insufficient, and when the total content is too large, electrical conductivity is decreased. Furthermore, when the total content is too large, those elements form intermetallic compounds with other elements depending on the selected element, to cause a defect, such as occurrence of slag upon melting, and the like. The content of Cu, Mg, and Si in total is preferably 0.1 to 0.4 mass %, more preferably 0.15 to 0.3 mass %.

Other composition of the alloy is the same as that of the above-mentioned first embodiment.

The aluminum alloy wire material of the present invention is produced, under strict control of the values of grain size, tensile strength (TS), 0.2% yield strength (YS), elongation, electrical conductivity, and TS/YS, which are elements other than the above-mentioned alloying elements.

The reasons why these values are defined are shown below.

Grain Size

The aluminum alloy wire material of the first embodiment of the present invention has a grain size of 5 to 25 μm, preferably 8 to 15 μm, more preferably 10 to 12 μm, in a vertical cross-section in the wire-drawing direction. This is because, when the grain size is too small, an unrecrystallized texture remains partially, and elongation is conspicuously decreased; and when the grain size is too large, deformation behavior becomes uneven, whereby elongation is decreased similarly, to cause a defect upon connecting (fitting) with a copper terminal.

Furthermore, the aluminum alloy wire material of the second embodiment, whose Fe content is high, has a grain size of 5 to 30 μm, preferably 8 to 15 μm, more preferably 10 to 12 μm, in a vertical cross-section in the wire-drawing direction of the wire material. When the content of Fe is higher, the grain size tends to be finer, whereby non-recrystallized region may remain. Accordingly, when the amount of Fe is high, it is preferable to conduct a heat treatment at a slightly higher temperature.

Tensile Strength, Elongation, And Electrical Conductivity

The aluminum alloy wire material of the present invention has a tensile strength (TS) of 80 MPa or more and an electrical conductivity of 55% IACS or more, preferably has a tensile strength of 80 to 150 MPa and an electrical conductivity of 55 to 65% IACS, and more preferably has a tensile strength of 100 to 120 MPa and an electrical conductivity of 58 to 62% IACS.

The tensile strength and the electrical conductivity are conflicting properties, and the higher the tensile strength is, the lower the electrical conductivity is, whereas pure aluminum low in tensile strength is high in electrical conductivity. Therefore, if an aluminum conductor is assumed, when the conductor has a tensile strength of 80 MPa or less, the conductor becomes so weak that use (including handling) of the conductor as an industrial conductor is difficult. Furthermore, an electrical conductivity of at least 55% IACS is required, since a high current of dozens of amperes (A) is applied, when used as an electric power transmission line.

The aluminum alloy wire material of the present invention has an elongation (El) of preferably 15% or more, more preferably 20% or more. When the elongation is too low, the wire material is not preferable as a stranded wire material. However, since the elongation also varies depending on the wire diameter of the elemental wire, a similar effect to that of the present invention can be obtained, for example, in the case where the elemental wire has a diameter of 0.3 mmϕ and an elongation of 12% or more, or in the case where the elemental wire has a diameter of 0.1 mmϕ and an elongation of 10% or more. Although the upper limit of the elongation is not particularly limited, it is generally 35% or less.

In the aluminum alloy wire material of the present invention, the ratio of tensile strength (TS) and 0.2% yield strength (YS) is controlled within a specific range.

The manner of stranding or twisting the wire materials differs, according to the ratio of TS and YS of the mechanical properties. This is due to difference in work-hardening index. The work-hardening index is generally referred to as an n value, and is one of indexes that show workability of a material. In general, it is considered that, when the work-hardening index becomes larger, the material in interest is deformed more easily. However, this index varies, depending on the alloy composition, the annealing method, the metal texture (grain size), and the like.

Furthermore, it is correct that a material having a higher elongation (El) is worked more easily. However, it is an index, and the higher the mechanical strength becomes, the lower the elongation is. Therefore, the material strength of a material for which mechanical strength is required, cannot always be decreased, so as to increase the elongation.

As a result of the above, in order to obtain an optimal stranded wire, a balance is required between the mechanical strength and the elongation, and between the grain size and the TS/YS. Namely, there is a suitable relationship between TS and YS for each alloy and the grain size thereof, and the relationship differs depending on the annealing method for realizing it.

In the present invention, all of TS, YS, and El are values measured by test methods according to JIS Z 2241.

In the case of an aluminum alloy wire material that has been annealed by a batch-type heat treatment, TS and YS satisfy the relationship represented by formula: $1.5 \leq (TS/YS) \leq 3$. When the TS/YS is too low, work-hardening is low, whereas when it is too high, work-hardening is high, and thus the resultant wire material becomes hard to be stranded. Preferably, the TS/YS is $2 \leq (TS/YS) \leq 2.5$.

In the case of an aluminum alloy wire material that has been subjected to a continuous electric current annealing heat treatment, TS and YS satisfy the relationship represented by formula: $1.2 \leq (TS/YS) \leq 2.2$. When the TS/YS is too low, work-hardening is low, whereas when it is too high, work-hardening is high, and thus the resultant wire material becomes hard to be stranded. Preferably, the TS/YS is $1.5 \leq (TS/YS) \leq 2$.

In the case of an aluminum alloy wire material that has been subjected to a continuous high-temperature and short-time annealing heat treatment, TS and YS satisfy the relationship represented by formula: $1 \leq (TS/YS) \leq 2$. When the TS/YS is too low, work-hardening is low, whereas when it is too high, work-hardening is high, and thus the resultant wire material becomes hard to be stranded. Preferably, the TS/YS is $1 \leq (TS/YS) \leq 1.3$, by which particularly excellent results can be attained.

The above-mentioned annealing methods are explained.

The batch-type heat treatment means a heat treatment in vacuo or under an inert gas atmosphere for a relatively long time period (for example, several minutes to several hours), in which a wire material is placed in a container called a heat treatment pot. By this method, the material placed in the pot is heat-treated nearly homogeneously.

The continuous electric current annealing heat treatment is a method, in which conductor rolls (electrodes) are provided in a wire-feeding step, while a wire material is feeding, a constant voltage is applied to between the electrodes, to bring the wire material into contact with the rolls to generate a Joule heat by the self-resistance that the wire material has, thereby to conduct annealing. In this method, the material is recrystallized by the heat treatment at a very high temperature (for example, 500° C. to 640° C.) in a very short time period (for example, 0.01 to 1 seconds).

The continuous high-temperature and short-time annealing heat treatment is a method, in which annealing is conducted by the radiant heat from the inside of a furnace, which heat is provided by passing a wire material in a heated furnace body. Also in this method, the material is recrystallized by the heat treatment at a high temperature in a short time period. The atmosphere in the continuous annealing furnace is generally an inert gas or a reducing atmosphere gas.

In the case of annealing by the batch-type heat treatment, the material that has been subjected to cold drawing, is subjected to a heat treatment preferably at a temperature of 300 to 450° C. for 10 to 120 minutes, further preferably at a temperature of 350 to 450° C. for 30 to 60 minutes. The temperature raising speed in the heat treatment is preferably 10 to 100° C./hour, and the cooling speed is preferably 10 to 100° C./hour.

The continuous electric current annealing heat treatment is preferably conducted at a voltage of 20 to 40 V and a current value of 180 to 360 A.

In the continuous high-temperature and short-time annealing heat treatment, the wire material is preferably fed to pass, at 30 to 150 m/min, through the inside of the furnace heated to 400 to 550° C.

The aluminum wire material of the present invention can be produced via steps of: melting, hot- or cold-working (e.g. caliber rolling with grooved rolls), wire drawing, and heat treatment (the above specific annealing).

The aluminum alloy wire material of the above-mentioned first embodiment can be produced, for example, in the following manner. An ingot is prepared, by melting and casting 0.1 to 0.4 mass % of Fe, 0.1 to 0.3 mass % of Cu, 0.02 to 0.2 mass % of Mg, and 0.02 to 0.2 mass % of Si, 0.001 to 0.01 mass % of Ti and V in total, with the balance being Al and unavoidable impurities. The ingot is subjected to hot caliber rolling, to give a rod material. The surface of the rod material is then subjected to shaving, followed by cold wire-drawing, to give a worked material, and the thus-worked material is subjected to a heat treatment (for example, at a temperature of 300 to 450° C. for 1 to 4 hours), followed by further wire-drawing. Finally, any of the above-mentioned specific annealings is conducted, whereby the aluminum alloy wire material can be prepared. Furthermore, then, the resultant wire material may further be subjected to cold working, if necessary.

Further, the aluminum alloy wire material of the above-mentioned second embodiment can be produced, for example, in the following manner. An ingot is prepared, by melting and casting 0.3 to 0.8 mass % of Fe, 0.02 to 0.5 mass % of at least one element selected from Cu, Mg, and Si in total, 0.001 to 0.01 mass % of Ti and V in total, with the balance being Al and unavoidable impurities. The ingot is subjected to hot caliber rolling, to give a rod material of about 10 mmϕ. The surface of the rod material is then subjected to shaving, followed by cold wire-drawing, to give a cold-drawn material. The thus-cold-drawn material is subjected to heat treatment (for example, at a temperature of 300 to 450° C. for 1 to 4 hours), followed by wire-drawing. Finally, any of the above-mentioned specific annealings is conducted, whereby the aluminum alloy wire material can be prepared. Furthermore, then, the resultant wire material may further be subjected to cold working, if necessary.

The cooling speed when the molten metal is cast to give the ingot, is generally 0.5 to 180° C./sec, preferably 1 to 50° C./sec, more preferably 1 to 20° C./sec. By setting the cooling speed to the above-mentioned range, the amount of Fe as a solid solution, and the size and density of a Fe-based precipitated product can be controlled.

Furthermore, the reduction ratio in the case where the cold working is conducted after the annealing is preferably 5 to 50%, more preferably 5 to 30%. By setting the reduction ratio within the above-mentioned range, a wire material can be prepared which is high in tensile strength and excellent in workability. As used herein, the reduction ratio is a value (%) represented by formula: {(cross-sectional area before working−cross-sectional area after working)/cross-sectional area before working}×100.

The aluminum alloy wire material of the present invention can be preferably used as, but not limited to, for example, an electrical conductor for a battery cable, harness, or motor, each of which is used in a movable body.

Further, examples of the movable body in which the aluminum alloy wire material of the present invention is to be mounted, include vehicles (e.g. automobiles, trains, and aircrafts).

EXAMPLES

The present invention will be described in more detail based on examples given below, but the invention is not meant to be limited by these.

Examples 1 to 20, and Comparative Examples 1 to 17

Fe, Cu, Mg, Si, Ti, V, and Al were melted in a siliconit furnace with a graphite pot in the amounts (mass %) shown in Tables 1 and 2, followed by casting at a cooling speed of 0.5 to 180° C./sec, to produce a respective inch bar ingot of 25×25 mm×300 mm. At that time, a K-type thermocouple was set at the inside of a cast mold, so that the temperature was continuously monitored every 0 to 2 seconds, and an average cooling speed from solidification to 200° C. was obtained, later. The respective ingot was subjected to hot caliber rolling, to prepare a rod material with diameter of about 10 mmϕ. The surface of the rod material was then subjected to shaving to diameter 9 to 9.5 mmϕ, followed by cold wire-drawing to diameter 2.6 mmϕ. The cold wire-drawn material was subjected to heat treatment at temperature 300 to 450° C. for 1 to 4 hours, followed by wire-drawing to diameter 0.3 mmϕ, and annealing by a batch-type heat treatment (A), a continuous electric current annealing heat treatment (B), or a continuous high-temperature and short-time annealing (CAL-type annealing) heat treatment (C), under the conditions described in the column of 'Heat treatment' 'Method' in Tables 1 and 2, to produce an aluminum alloy wire material, respectively.

The distance between the electrodes was 80 cm, and the wire feeding speed was 300 to 800 m/min in the continuous electric current annealing heat treatment (B). Further, the full length of the heat treatment furnace used in the continuous high-temperature and short-time annealing heat treatment (C) was 310 cm.

With respect to the aluminum alloy wire materials prepared in Examples (Ex) and Comparative examples (Comp. ex), the properties were measured according to the methods described below, and the results thereof are shown in Tables 1 to 2.

(a) Grain Size (GS)

The transverse cross-section of a sample that was cut out in the wire-drawing direction was embedded with a resin, followed by mechanical polishing, and electrolytic polishing. The conditions of the electrolytic polishing were as follows: polish liquid, a 20% ethanol solution of perchloric acid; liquid temperature, 0 to 5° C.; current, 10 mA; voltage, 10 V; and time period, 30 to 60 seconds. The resultant microstructure was observed by an optical microscope with a magnification of 200× to 400× and photographed, and the grain size was measured by an intersection method. Specifically, the photographed picture was enlarged to about 4-fold, straight lines were drawn thereon, and the number of intersections of the straight lines and grain boundaries was measured, to obtain the average grain size. The grain size was evaluated by changing the length and the number of straight lines so that 100 to 200 grains would be counted.

(b) Tensile Strength (TS)

Three test pieces which were cut out in the wire-drawing direction, were tested according to JIS Z 2241. The maximum load in the test was read out, and divided by the cross-sectional area of the test piece, to obtain the average value.

(c) 0.2% Yield Strength (YS)

The 0.2% yield strength (YS) was determined, by testing three test pieces that were cut out in the wire-drawing direction according to JIS Z 2241, reading the load corresponding to the YS upon the test from a chart, and dividing the load by the cross-sectional area of the test piece, to obtain the average value.

(d) Elongation (El)

Three test pieces that were cut out in the wire-drawing direction were tested according to JIS Z 2241. The test piece was provided with marks before the test, and an elongation was calculated by measuring the interval of the marks after the test in comparison to the interval before the test, to obtain the average value.

(e) Electrical Conductivity (EC)

A test piece with length 350 mm which was cut out in the wire-drawing direction, was immersed in a thermostat bath maintained at 20° C. (±2° C.), and electric resistance was measured by using a four terminal method, to calculate the electrical conductivity. The distance between the terminals was 300 mm.

TABLE 1

| Ex No. | Fe | Cu | Mg (mass %) | Si | Ti + V | Al | Cooling speed (° C./sec) | Heat treatment Method | GS (μm) | TS (MPa) | 0.2% YS (MPa) | El (%) | EC (% IACS) | TS/YS |
|---|---|---|---|---|---|---|---|---|---|---|---|---|---|---|
| 1 | 0.15 | 0.20 | 0.12 | 0.06 | 0.003 | Bal. | 60 | A: 380° C., 1 h | 12 | 122 | 66 | 21.4 | 61.1 | 1.8 |
| 2 | | | | | | | | B: 31 V, 278 A | 11 | 124 | 98 | 21.0 | 60.5 | 1.3 |
| 3 | | | | | | | | C: 480° C., 60 m/min | 13 | 120 | 82 | 20.8 | 60.8 | 1.5 |
| 4 | 0.35 | 0.11 | 0.20 | 0.14 | 0.005 | Bal. | 120 | A: 300° C., 1 h | 11 | 125 | 58 | 22.7 | 59.2 | 2.2 |
| 5 | | | | | | | | B: 25 V, 224 A | 10 | 126 | 81 | 22.5 | 59.1 | 1.5 |
| 6 | | | | | | | | C: 520° C., 140 m/min | 12 | 125 | 72 | 22.8 | 59.3 | 1.7 |
| 7 | 0.1 | 0.12 | 0.13 | 0.03 | 0.008 | Bal. | 180 | A: 450° C., 0.5 h | 17 | 118 | 52 | 23.3 | 61.3 | 2.3 |
| 8 | 0.18 | 0.19 | 0.10 | 0.08 | 0.002 | Bal. | 160 | B: 38 V, 335 A | 16 | 120 | 101 | 22.0 | 61.1 | 1.2 |
| 9 | 0.20 | 0.25 | 0.06 | 0.11 | 0.003 | Bal. | 90 | C: 460° C., 70 m/min | 13 | 122 | 80 | 21.0 | 60.5 | 1.5 |
| 10 | 0.22 | 0.29 | 0.16 | 0.19 | 0.004 | Bal. | 80 | A: 400° C., 2 h | 14 | 130 | 44 | 18.7 | 58.3 | 3.0 |
| 11 | 0.25 | 0.10 | 0.20 | 0.10 | 0.009 | Bal. | 30 | B: 21 V, 196 A | 8.7 | 128 | 107 | 22.9 | 59.4 | 1.2 |
| 12 | 0.30 | 0.15 | 0.03 | 0.15 | 0.006 | Bal. | 60 | C: 420° C., 40 m/min | 11 | 115 | 96 | 23.9 | 60.3 | 1.2 |
| 13 | 0.34 | 0.13 | 0.18 | 0.05 | 0.001 | Bal. | 10 | A: 400° C., 1 h | 14 | 124 | 48 | 22.4 | 61.0 | 2.6 |
| 14 | 0.40 | 0.23 | 0.09 | 0.17 | 0.003 | Bal. | 140 | B: 30 V, 248 A | 12 | 123 | 88 | 21.1 | 59.2 | 1.4 |
| 15 | 0.55 | 0.12 | — | 0.10 | 0.003 | Bal. | 20 | A: 350° C., 2 h | 8.6 | 103 | 60 | 31.7 | 62.3 | 1.7 |
| 16 | | | | | | | | B: 36 V, 313 A | 13 | 105 | 84 | 31.5 | 62.0 | 1.3 |
| 17 | | | | | | | | C: 540° C., 100 m/min | 15 | 105 | 71 | 31.3 | 62.1 | 1.5 |
| 18 | 0.75 | 0.21 | 0.08 | 0.08 | 0.002 | Bal. | 170 | A: 300° C., 1 h | 8.1 | 110 | 53 | 29.8 | 61.0 | 2.1 |
| 19 | | | | | | | | B: 26 V, 232 A | 9.2 | 112 | 86 | 30.6 | 61.2 | 1.3 |
| 20 | | | | | | | | C: 400° C., 50 m/min | 8.4 | 109 | 94 | 30.8 | 61.1 | 1.2 |

A: batch-type heat treatment, B: electric current annealing, C: CAL-type annealing

TABLE 2

| Comp ex No. | Fe | Cu | Mg (mass %) | Si | Ti + V | Al | Cooling speed (° C./sec) | Heat treatment Method | GS (μm) | TS (MPa) | 0.2% YS (MPa) | El (%) | EC (% IACS) | TS/YS |
|---|---|---|---|---|---|---|---|---|---|---|---|---|---|---|
| 1 | 0.03 | 0.15 | 0.10 | 0.08 | 0.002 | Bal. | 120 | A: 350° C., 2 h | 24 | 76 | 23 | 23.0 | 60.2 | 3.3 |
| 2 | 0.20 | 0.03 | 0.13 | 0.08 | 0.002 | Bal. | 70 | B: 32 V, 290 A | 13 | 96 | 84 | 25.6 | 60.3 | 1.1 |
| 3 | 0.23 | 0.42 | 0.15 | 0.10 | 0.001 | Bal. | 110 | C: 480° C., 80 m/min | 12 | 135 | 80 | 15.6 | 54.1 | 1.7 |
| 4 | 0.25 | 0.11 | 0.001 | 0.12 | 0.001 | Bal. | 130 | A: 300° C., 2 h | 12 | 76 | 23 | 25.2 | 60.5 | 3.3 |
| 5 | 0.20 | 0.12 | 0.31 | 0.12 | 0.002 | Bal. | 120 | B: 32 V, 292 A | 14 | 120 | 105 | 21.0 | 53.8 | 1.1 |
| 6 | 0.21 | 0.11 | 0.13 | 0.006 | 0.001 | Bal. | 120 | C: 480° C., 80 m/min | 14 | 75 | 34 | 23.6 | 60.8 | 2.2 |
| 7 | 0.30 | 0.20 | 0.13 | 0.34 | 0.003 | Bal. | 60 | A: 300° C., 2 h | 11 | 130 | 66 | 21.3 | 54.0 | 2.0 |
| 8 | 0.30 | 0.20 | 0.14 | 0.12 | 0.020 | Bal. | 30 | B: 32 V, 285 A | 11 | 124 | 88 | 21.2 | 54.1 | 1.4 |
| 9 | 0.64 | 0.001 | 0.005 | 0.010 | 0.001 | Bal. | 20 | C: 480° C., 80 m/min | 8.6 | 71 | 32 | 27.9 | 62.2 | 2.2 |
| 10 | 0.70 | 0.60 | — | 0.03 | 0.003 | Bal. | 100 | A: 350° C., 2 h | 8.1 | 137 | 55 | 16.5 | 53.6 | 2.5 |
| 11 | 0.71 | 0.31 | 0.32 | 0.12 | 0.003 | Bal. | 10 | B: 32 V, 291 A | 8.0 | 153 | 112 | 16.1 | 52.3 | 1.4 |
| 12 | 0.25 | 0.15 | 0.08 | 0.09 | 0.003 | Bal. | 110 | A: 250° C., 1 h | Not recrystallized | 156 | 123 | 2.8 | 60.1 | 1.3 |
| 13 | | | | | | | | A: 400° C., 0.03 h | Not recrystallized | 145 | 110 | 3.2 | 59.5 | 1.3 |
| 14 | | | | | | | | B: 14 V, 105 A | Not recrystallized | 173 | 142 | 2.6 | 59.3 | 1.2 |
| 15 | | | | | | | | B: 42 V, 383 A | 35 | 72 | 23 | 5.4 | 60.6 | 3.1 |
| 16 | | | | | | | | C: 320° C., 100 m/min | Not recrystallized | 182 | 133 | 1.5 | 59.6 | 1.4 |
| 17 | | | | | | | | C: 600° C., 100 m/min | 39 | 71 | 22 | 5.2 | 60.8 | 3.2 |

As is apparent from Table 1 and Table 2, the tensile strength was low as 76 MPa or less and the TS/YS was high as 3.3 in Comparative example 1 in which the amount of Fe was too small. The TS/YS was low as 1.1 in Comparative example 2 in which the amount of Cu was too small; and the electrical conductivity was low as 54.1% IACS in Comparative example 3 in which the amount of Cu was too large. The tensile strength was low as 76 MPa and the TS/YS was high as 3.3 in Comparative example 4 in which the amount of Mg was too small; and the electrical conductivity was low as 53.8% IACS and the TS/YS was low as 1.1 in Comparative example 5 in which the amount of Mg was too large. The tensile strength was low as 75 MPa and the TS/YS was high as 2.2 in Comparative example 6 in which the amount of Si was too small; and the electrical conductivity was low as 54.0% IACS in Comparative example 7 in which the amount of Si was too large. The electrical conductivity was low as 54.1% IACS in Comparative example 8 in which the total amount of Ti and V was too large. The tensile strength was low as 71 MPa and the TS/YS was high as 2.2 in Comparative example 9 in which the total amount of Cu, Mg, and Si was too small; and the electrical conductivity was low as 53.6% IACS or less in Comparative examples 10 and 11 in each of which the total amount of Cu, Mg, and Si was too large. The elongation was low as 3.2% or less in Comparative examples 12 to 14, and 16 each of which was not recrystallized, and the TS/YS was low as 1.3 in Comparative examples 12 and 13. The tensile strength was low as 72 MPa or less, the elongation was low as 5.4% or less, and the TS/YS was high as 3.1 or more, in Comparative examples 15 and 17 in each of which the grain size was too large.

Contrary to the above, Examples 1 to 20 gave aluminum alloy wire materials which were excellent in both of the mechanical properties and the electrical conductivity, and which are preferable for stranded wires for use in wire harnesses, and the like, to be mounted on movable bodies.

Examples 101 to 115, and Comparative Examples 101 to 102

Next, other Examples and Comparative examples are shown. Aluminum alloy wire materials were obtained in the same manner as mentioned above, except that the alloy composition was changed to those described in Tables 3 and 4, respectively. In Comparative example 101, the final annealing heat treatment was not conducted. The properties were measured and evaluated in the same manner as mentioned above. Table 3 shows Examples according to the present invention, and Table 4 shows Comparative examples, respectively.

TABLE 3

| Ex No. | Fe | Cu | Mg (mass %) | Si | Ti + V | Al | Cooling speed (° C./sec) | Heat treatment Method | GS (μm) | TS (MPa) | 0.2% YS (MPa) | El (%) | EC (% IACS) | TS/YS |
|---|---|---|---|---|---|---|---|---|---|---|---|---|---|---|
| 101 | 0.10 | 0.12 | 0.04 | 0.18 | 0.003 | Bal. | 20 | A: 400° C., 1 h | 17 | 107 | 45 | 24.5 | 60.8 | 2.4 |
| 102 | 0.13 | 0.20 | 0.17 | 0.06 | 0.005 | Bal. | 10 | B: 32 V, 290 A | 16 | 114 | 85 | 20.8 | 60.4 | 1.3 |
| 103 | 0.20 | 0.13 | 0.12 | 0.15 | 0.008 | Bal. | 0.5 | C : 420° C., 40 m/min | 10 | 114 | 76 | 23.2 | 59.5 | 1.5 |
| 104 | 0.20 | 0.20 | 0.05 | 0.08 | 0.003 | Bal. | 5 | A: 450° C., 0.5 h | 15 | 115 | 49 | 22.4 | 61.3 | 2.3 |
| 105 | 0.21 | 0.26 | 0.20 | 0.06 | 0.005 | Bal. | 50 | B: 26 V, 250 A | 11 | 124 | 87 | 18.9 | 59.6 | 1.4 |
| 106 | 0.23 | 0.30 | 0.08 | 0.14 | 0.009 | Bal. | 10 | A: 350° C., 2 h | 8.5 | 126 | 54 | 19.5 | 58.8 | 2.3 |
| 107 | 0.28 | 0.13 | 0.13 | 0.14 | 0.007 | Bal. | 1 | C: 480° C., 80 m/min | 11 | 118 | 79 | 23.1 | 59.5 | 1.5 |
| 108 | 0.29 | 0.19 | 0.10 | 0.03 | 0.002 | Bal. | 20 | B: 22 V, 220 A | 7.6 | 119 | 90 | 22.0 | 61.6 | 1.3 |
| 109 | 0.30 | 0.22 | 0.19 | 0.08 | 0.002 | Bal. | 10 | A: 400° C., 0.17 h | 9.3 | 126 | 54 | 20.0 | 59.9 | 2.3 |
| 110 | 0.32 | 0.28 | 0.06 | 0.11 | 0.004 | Bal. | 1 | A: 300° C., 2 h | 7.3 | 128 | 56 | 20.2 | 60.0 | 2.3 |
| 111 | 0.38 | 0.12 | 0.07 | 0.20 | 0.005 | Bal. | 5 | C: 550° C., 140 m/min | 9.8 | 123 | 77 | 24.1 | 59.4 | 1.6 |
| 112 | 0.40 | 0.22 | 0.13 | 0.15 | 0.008 | Bal. | 20 | B: 37 V, 320 A | 9.7 | 131 | 86 | 20.8 | 58.5 | 1.5 |
| 113 | 0.59 | 0.15 | — | 0.08 | 0.005 | Bal. | 10 | B: 28 V, 270 A | 7.5 | 118 | 78 | 29.3 | 61.0 | 1.5 |
| 114 | 0.68 | — | 0.08 | 0.15 | 0.003 | Bal. | 20 | A: 400° C., 0.5 h | 7.2 | 119 | 52 | 32.0 | 60.4 | 2.3 |
| 115 | 0.80 | — | — | 0.13 | 0.004 | Bal. | 5 | A: 350° C., 1 h | 6.5 | 110 | 48 | 33.0 | 61.0 | 2.3 |

TABLE 4

| Comp ex No. | Fe | Cu | Mg (mass %) | Si | Ti + V | Al | Cooling speed (° C./sec) | Heat treatment Method | GS (μm) | TS (MPa) | 0.2% YS (MPa) | El (%) | EC (% IACS) | TS/YS |
|---|---|---|---|---|---|---|---|---|---|---|---|---|---|---|
| 101 | 0.21 | 0.19 | 0.08 | 0.06 | 0.003 | Bal. | 20 | None | Not recrystallized | 280 | 255 | 1.0 | 59.4 | 1.1 |
| 102 | 1.3 | — | — | 0.06 | 0.005 | Bal. | 10 | A: 400° C., 0.5 h | 2.5 | 130 | 56 | 12.3 | 58.0 | 2.3 |

As is apparent from Tables 3 and 4, in Comparative example 101 in which the final annealing heat treatment was not conducted, the metal grain was not recrystallized, the value of TS/YS was small, and the value of elongation was small. In Comparative example 102 in which the amount of Fe was too large, the elongation was resulted in a small value.

Contrary to the above, Examples 101 to 115 gave aluminum alloy wire materials which were excellent in both of the mechanical properties and the electrical conductivity, and which are preferable for stranded wires for use in wire harnesses, and the like, to be mounted on movable bodies.

The invention claimed is:

1. An aluminum alloy wire material, which has an alloy composition consisting essentially of: 0.1 to 0.4 mass % of Fe, 0.1 to 0.3 mass % of Cu, 0.02 to 0.2 mass % of Mg, and 0.02 to 0.2 mass % of Si, and further consisting essentially of 0.001 to 0.01 mass % of Ti and V in total, with the balance being Al and unavoidable impurities, wherein a grain size is 5 to 25 μm in a vertical cross-section in a wire-drawing direction of the wire material, wherein, according to JIS Z 2241, a tensile strength (TS) is 80 MPa or more, an elongation (El) is 15% or more, and a 0.2% yield strength (YS; MPa) satisfies, together with the TS, a relationship represented by formula: $1.2 \leq (TS/YS) \leq 1.5$, and wherein an electrical conductivity is 55% IACS or more.

2. The aluminum alloy wire material according to claim 1, which is mounted on a movable body as a wiring, and used in the form of a stranded wire as an electric conductor for a battery cable, a wire harness, or a motor.

3. An aluminum alloy wire material, which has an alloy composition consisting essentially of: 0.1 to 0.4 mass % of Fe, 0.1 to 0.3 mass % of Cu, 0.02 to 0.2 mass % of Mg, and 0.02 to 0.2 mass % of Si, and further consisting essentially of 0.001 to 0.01 mass % of Ti and V in total, with the balance being Al and unavoidable impurities, wherein a grain size is 5 to 25 μm in a vertical cross-section in a wire-drawing direction of the wire material, wherein, according to JIS Z 2241, a tensile strength (TS) is 80 MPa or more, an elongation (El) is 15% or more, and a 0.2% yield strength (YS; MPa) satisfies, together with the TS, a relationship represented by formula: $1 \leq (TS/YS) \leq 1.7$, and wherein an electrical conductivity is 55% IACS or more.

4. The aluminum alloy wire material according to claim 3, which is mounted on a movable body as a wiring, and used in the form of a stranded wire as an electric conductor for a battery cable, a wire harness, or a motor.

5. An aluminum alloy wire material, which has an alloy composition consisting essentially of: 0.3 to 0.8 mass % of Fe, and 0.02 to 0.5 mass % of at least one element selected from the group consisting of Cu, Mg, and Si in total, and further consisting essentially of 0.001 to 0.01 mass % of Ti and V in total, with the balance being Al and unavoidable impurities, wherein a grain size is 5 to 30 μm in a vertical cross-section in a wire-drawing direction of the wire material, wherein, according to JIS Z 2241, a tensile strength (TS) is 80 MPa or more, an elongation (El) is 15% or more, and a 0.2% yield strength (YS; MPa) satisfies, together with the TS, a relationship represented by formula: $1.2 \leq (TS/YS) \leq 1.5$, and wherein an electrical conductivity is 55% IACS or more.

6. The aluminum alloy wire material according to claim 5, which is mounted on a movable body as a wiring, and used in the form of a stranded wire as an electric conductor for a battery cable, a wire harness, or a motor.

7. An aluminum alloy wire material, which has an alloy composition consisting essentially of: 0.3 to 0.8 mass % of Fe, and 0.02 to 0.5 mass % of at least one element selected from the group consisting of Cu, Mg, and Si in total, and further consisting essentially of 0.001 to 0.01 mass % of Ti and V in total, with the balance being Al and unavoidable impurities, wherein a grain size is 5 to 30 μm in a vertical cross-section in a wire-drawing direction of the wire material, wherein, according to JIS Z 2241, a tensile strength (TS) is 80 MPa or more, an elongation (El) is 15% or more, and a 0.2% yield strength (YS; MPa) satisfies, together with the TS, a relationship represented by formula: $1 \leq (TS/YS) \leq 1.6$, and wherein an electrical conductivity is 55% IACS or more.

8. The aluminum alloy wire material according to claim 7, which is mounted on a movable body as a wiring, and used in the form of a stranded wire as an electric conductor for a battery cable, a wire harness, or a motor.

9. The aluminum alloy wire material according to claim 3, wherein the 0.2% yield strength satisfies, together with the TS, a relationship represented by formula: $1 \leq (TS/YS) \leq 1.3$.

10. The aluminum alloy wire material according to claim 7, wherein the 0.2% yield strength satisfies, together with the TS, a relationship represented by formula: $1 \leq (TS/YS) \leq 1.3$.

* * * * *

UNITED STATES PATENT AND TRADEMARK OFFICE

CERTIFICATE OF CORRECTION

PATENT NO. : 8,951,370 B2
APPLICATION NO. : 13/184901
DATED : February 10, 2015
INVENTOR(S) : Shigeki Sekiya et al.

It is certified that error appears in the above-identified patent and that said Letters Patent is hereby corrected as shown below:

ON THE TITLE PAGE:

At item (63), Related U.S. Application Data, change "Continuation of application No. PCT/CT2010/050577, filed on Jan. 19, 2010." to --Continuation of application No. PCT/JP2010/050577, filed on Jan. 19, 2010.--.

Signed and Sealed this
Twenty-ninth Day of September, 2015

Michelle K. Lee

Michelle K. Lee
*Director of the United States Patent and Trademark Office*